US007360917B2

(12) United States Patent
Chien

(10) Patent No.: US 7,360,917 B2
(45) Date of Patent: Apr. 22, 2008

(54) LAMP HOLDER WITH A SECURING STAKE

(76) Inventor: Chao Chuan Chien, 8F, No. 387, Chung Cheng Road, Hsin Chuang City, Taipei Hsien (TW)

( * ) Notice: Subject to any disclaimer, the term of this patent is extended or adjusted under 35 U.S.C. 154(b) by 120 days.

(21) Appl. No.: 11/349,159

(22) Filed: Feb. 8, 2006

(65) Prior Publication Data

US 2006/0198153 A1 Sep. 7, 2006

(30) Foreign Application Priority Data

Mar. 2, 2005 (CN) ..... 2005 2 0007302 U

(51) Int. Cl.
*E01F 9/00* (2006.01)

(52) U.S. Cl. ..... 362/153.1; 362/184; 362/276

(58) Field of Classification Search ..... 362/145, 362/153, 153.1, 183, 184, 276, 368, 371, 362/802

See application file for complete search history.

(56) References Cited

U.S. PATENT DOCUMENTS 3,104,064 A * 9/1963 Bellek ..... 362/267
5,065,291 A * 11/1991 Frost et al. ..... 362/183
5,386,356 A * 1/1995 Davis et al. ..... 362/267
6,087,780 A * 7/2000 Benny ..... 315/185 S
7,041,899 B2 * 5/2006 Stekelenburg ..... 174/50
7,137,721 B1 * 11/2006 Rao et al. ..... 362/371

* cited by examiner

*Primary Examiner*—John Anthony Ward
(74) *Attorney, Agent, or Firm*—Troxell Law Office, PLLC

(57) ABSTRACT

A lamp holder with a securing stake is disclosed, comprising a power input line provided with a plug; a main body provided with an accommodating space whose front end is provided with an opening, whose back end is provided with an power line opening for the passing of a power line, and whose bottom is provided with a protrusion, which is provided with a connecting part; a bulb socket disposed in the accommodating space; a control circuit disposed in the accommodating space and coupled with the lamp holder and the power line; and a stake whose upper end is provided with a protrusion which is provided with a connecting part, such that the connecting part of the main body and the connecting part of the securing stake can be connected together to assemble the lamp holder with a securing stake.

13 Claims, 7 Drawing Sheets

LAMP HOLDER WITH A SECURING STAKE

FIELD OF THE INVENTION

The present invention relates to a lamp holder with a securing stake to secure the holder in a garden or yard, and particularly to a lamp holder with a securing stake, which is equipped with a timer or light sensor to facilitate more efficient control of on and off of the lamp.

BACKGROUND OF THE INVENTION

A lamp holder used outdoors, a garden or yard for example, is usually with its electric line and holder lying on the ground casually. The holder is therefore susceptible to rain and wind. The lamp holder can be neither fixed nor energy saving; when the power is connected, the bulb will be lit until the switch of the lamp is turned on manually, and on the other hand, the power be disconnected until the switch is turned off manually. Consequently, it is necessary to provide a lamp holder with a securing stake and is equipped with a timer or light sensor to facilitate more efficient control of on and off of the lamp.

SUMMARY OF THE INVENTION

An object of the present invention is to provide a lamp holder with a securing stake to secure the holder in a garden or yard, and particularly to a lamp holder with a securing stake, which is equipped a timer to facilitate more efficient control of on and off of the lamp.

Another object of the present invention is to provide a lamp holder with a securing stake to secure the holder in a garden or yard, and particularly to a lamp holder with a securing stake, which is equipped with a light sensor to facilitate more efficient control of on and off of the lamp.

A lamp holder with a securing stake according to the present invention comprises a power input line provided with a plug; a main body provided with an accommodating space whose front end is provided with an opening, whose back end is provided with an power line opening for the passing of a power line, and whose bottom is provided with a protrusion, which is provided with a connecting part; a bulb socket disposed in the accommodating space; a control circuit disposed in the accommodating space and coupled with the bulb socket and the power line; and a stake whose upper end is provided with a protrusion which is provided with a connecting part, such that the connecting part of the main body and the connecting part of the securing stake can be connected together to assemble the lamp holder with a securing stake.

BRIEF DESCRIPTION OF THE DRAWINGS

The present invention can be more fully understood by reference to the following description and accompanying drawings, in which.

DETAILED DESCRIPTION OF THE INVENTION

Figure 1A:
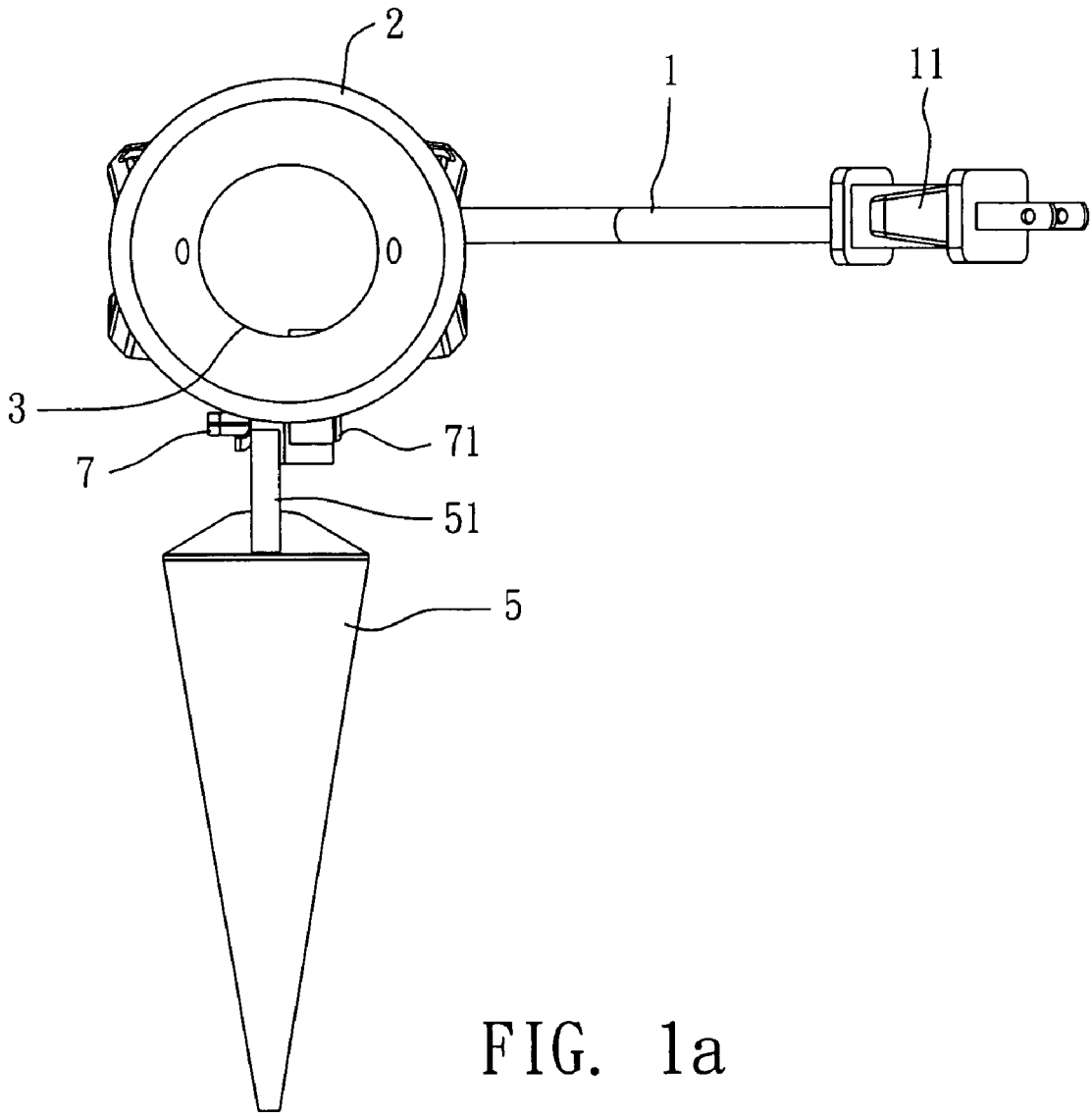
FIGS. 1(*a*) and 1(*b*) are schematic front view and left-side view, respectively, of a preferred embodiment of a lamp holder with a securing stake according to the present invention.
Figure 1B:
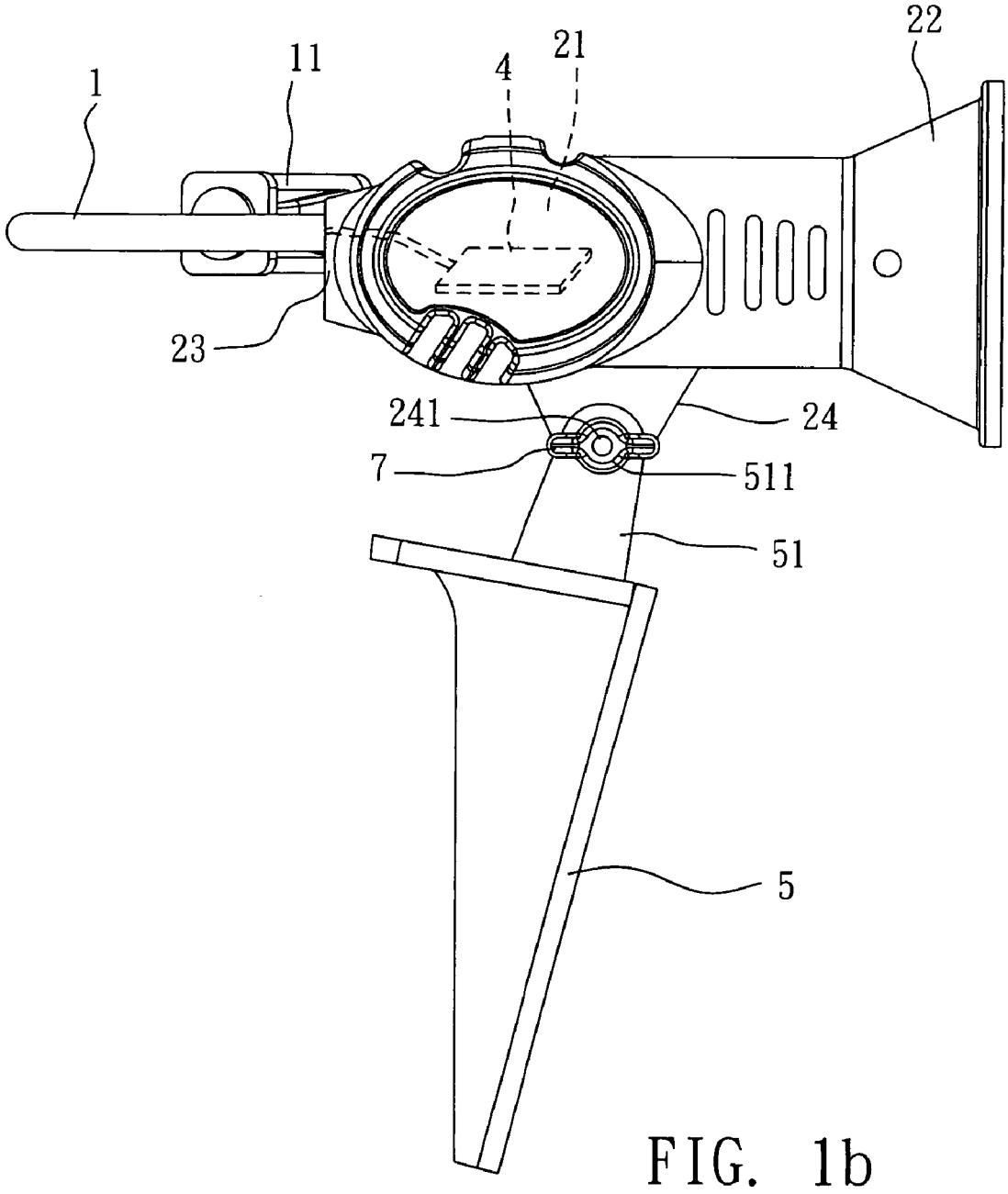

FIGS. 1(*a*) and 2(*b*) are schematic front view and left-side view, respectively, of a preferred embodiment of a lamp holder with a securing stake according to the present invention. The lamp holder with a securing stake according to present invention comprises a power input line 1; a main body 2, a bulb socket 3, a control circuit 4, and a securing stake 5.

Wherein, the power input line 1 whose one end is provided with a plug 11 for coupling with a power supply (not shown), an alternate current of 110V or 220V for example.

The main body 2 is provided with a accommodating space 21 whose front end is provided with a opening 22, for example but not limited to a flaring opening, whose back end is provided with a power line opening 23 for the passing of the power input line 1, and whose bottom is provided with a protrusion 24, which is provided with a connecting part 241, for example but not limited to a tightening hole. Furthermore, the main body 2 is made of plastic material or metal material, and the main body 2 is made by molding method when it is made of plastic material.

The bulb socket 3 is secured in the accommodating space 21 to secure a bulb (not shown) therein.

The control circuit 4 is secured in the accommodating space 21 and coupled with the bulb socket 3 and the power input line 1 to control the flow of electric current to the lamp holder.

The stake 5 is provided with a protrusion 51 on its upper end and the protrusion 51 is provided with a connecting part 511, which is a, for example but not limited to, a tightening hole. Furthermore, the lower end of the stake 5 is decreasing in size into a sharp end such that the lamp holder can be secured in a garden or yard. The main body 2 and the securing stake 5 are preferably made of insulating material, for example but not limited to plastics.

Upon assembling, the power input line 1 may first be put through the power line opening 23, and then the bulb socket 3 and the control circuit 4 are disposed in sequence into the accommodating space 21. The power input line 1 is then coupled with the control circuit 4. Finally, a screw 7 is put through the connecting part 241 of the main body 2 and the connecting part 511 of the securing stake 5, and a nut 71 is screwed into the screw 7 to complete the assembly of the lamp holder with a securing stake according to the present invention.

Figure 2:
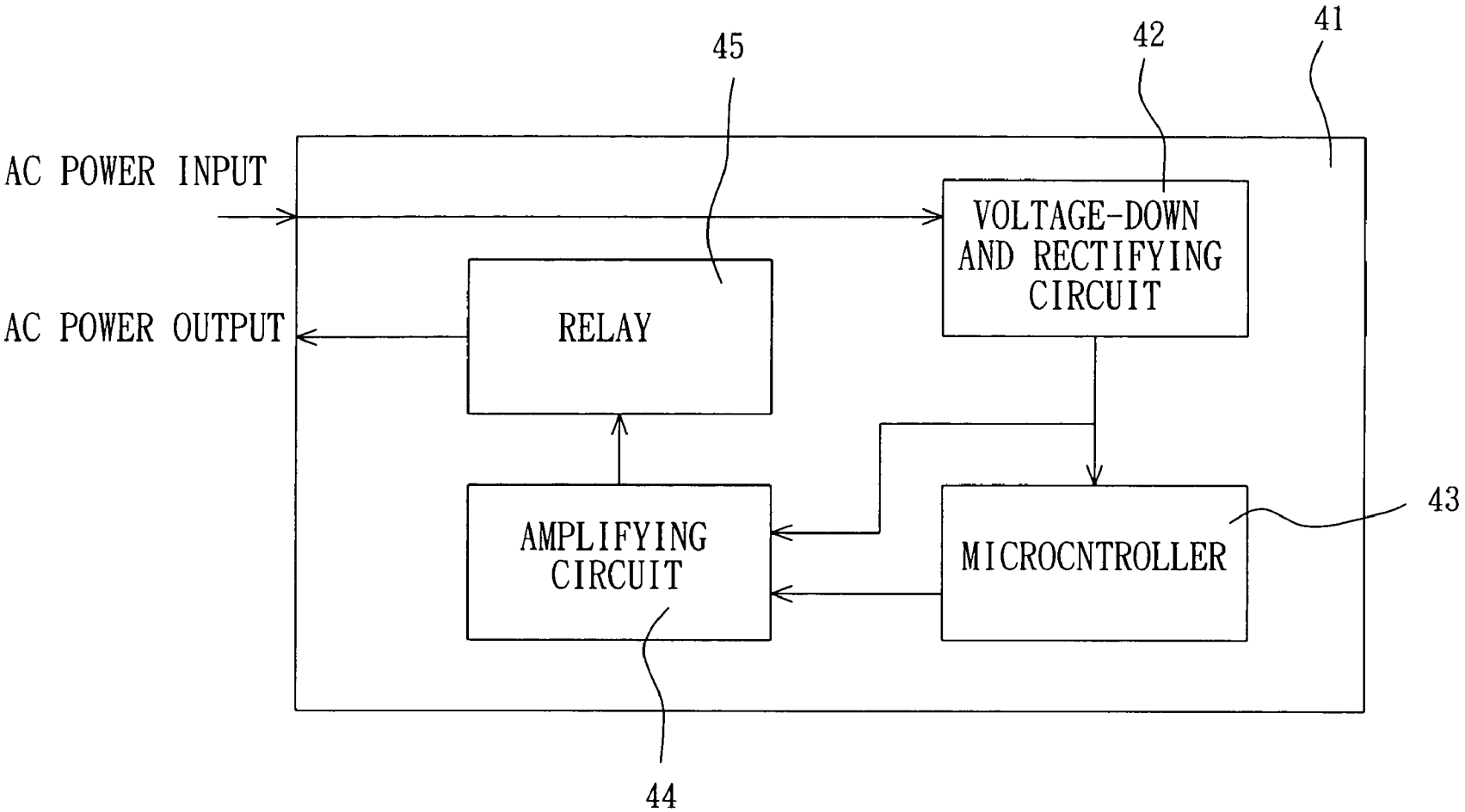
FIG. 2 is a schematic block diagram of a preferred embodiment of the control circuit 4 of a lamp holder with a securing stake according to the present invention.
Figure 4:
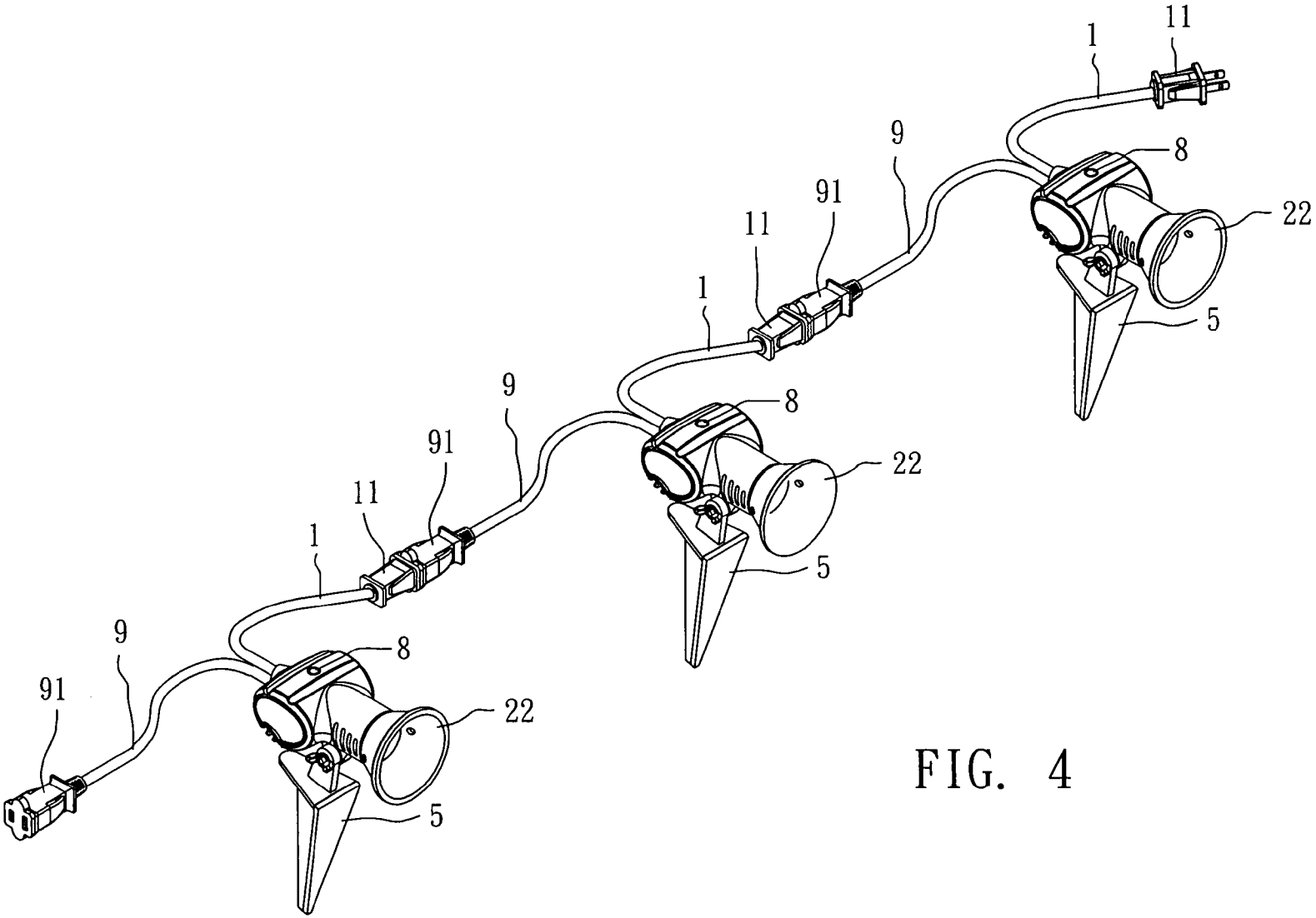
FIG. 4 is a perspective assembly view of another preferred embodiment of a lamp holder with a securing stake according to the present invention.

FIG. 2 illustrates a block diagram a preferred embodiment of the control circuit 4 according to the present invention. Referring to FIG. 4, the control circuit 4 according to the present invention further comprises a printed circuit board 41, a voltage-down and rectifying circuit 42, a microcontroller 43, an amplifying circuit 44, and a relay 45.

The voltage-down and rectifying circuit 42 is disposed on the printed circuit board 41 and coupled with the power input line 1 such that the alternate current input from the power supply can be reduced in voltage and rectified into direct current for the use of the microcontroller 43.

The microcontroller 43 is disposed on the printed circuit board 41 and coupled with the voltage-down and rectifying circuit 42. A preferred embodiment of the microcontroller 43 is an Application-Specific Integrated Circuit (ASIC). The microcontroller 43 further comprises a timer therein (not shown).

The amplifying circuit 44 is disposed on the printed circuit board 41 and coupled with the microcontroller 43, which is, for example but not limited to, a transistor (a PNP transistor in the present embodiment). The amplifying circuit 44 may be controlled by the microcontroller 43 to amplify the electric current for actuate the relay 45.

The relay 45 is disposed on the printed circuit board 41 and coupled with the amplifying circuit 44. The relay 45 may be controlled by the microcontroller 43 to connect or disconnect the electric current output to the bulb socket 3.

The operation of the present invention can be described as follows: When electric current is first transmitted to the lamp holder, the microcontroller 43 starts to count 6 hours of time and control the relay 45 to output electric current to the bulb socket 3 such that the bulb on the bulb socket 3 is turned on. At the end of the 6 hours, the microcontroller 43 turns off the relay 45 to disconnect electric current to the bulb socket 3 such that the bulb on the bulb socket 3 is turned off. Meanwhile, the timer in the microcontroller 43 starts to count 18 hours. At the end of the 18 hours, the microcontroller 43 starts again to count 6 hours and, in the mean time control the relay 45 to output electric current to the bulb of the bulb socket 3 to turn on the bulb. In the way, the on and off of the bulb on the bulb socket 3 can be controlled.

Figure 3:
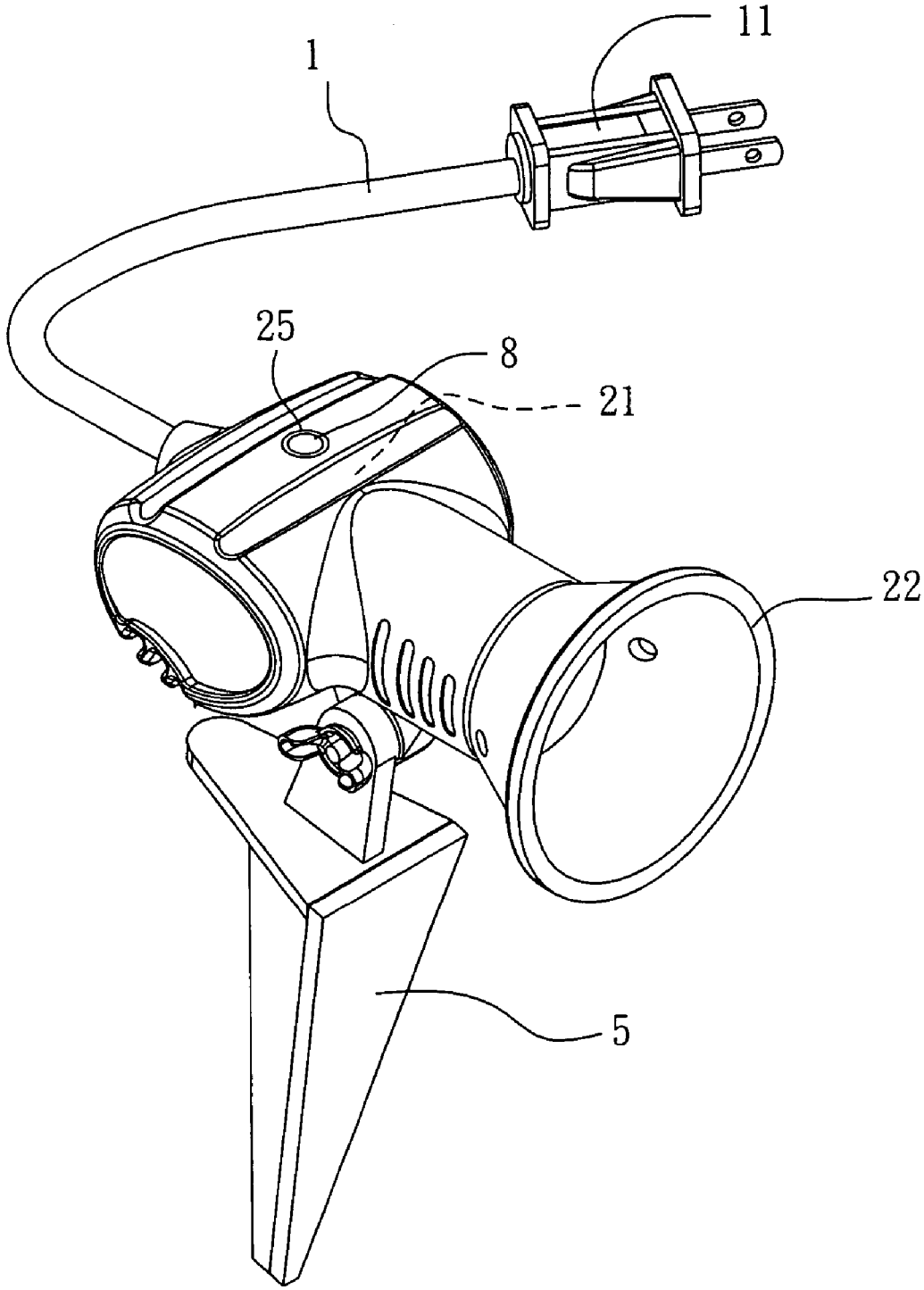
FIG. 3 is a perspective assembly view of another preferred embodiment of a lamp holder with a securing stake according to the present invention.

FIG. 3 is a perspective assembly view of another preferred embodiment according to the present invention. Referring to the FIG. 3, another preferred embodiment according to the present invent further comprises a light sensor 8 and a transparent window 25 is provided on the top of the main body 2. Wherein, the light sensor 8 is, for example but not limited to, a photo resistor (CDS), which is disposed in the accommodating space 21 and coupled with the control circuit 43. The light sensor 8 is attached close to the transparent window 25 such that the light sensor 8 can receive light signals from a garden or yard and can be water-proof.

The operation of the present invention can be described as follows: When electric current is first transmitted to the bulb socket 3, if the light sensor 8 detects light signals, the microcontroller 43 will control the relay 45 to disconnect electric current output to the bulb socket 3 such that the bulb on the bulb socket 3 is turned off. If the light sensor 8 detects no light signals, the microcontroller 43 starts to count 6 hours and controls the relay 45 to output electric current to the bulb socket 3 such that the bulb on the bulb socket 3 is turned on. The microcontroller 43 will only control the relay 45 to disconnect electric current after the 6 hours of counting unless the light sensor 8 detects very strong light during the 6 hours period of counting (this function is intended to prevent car light or street lamp from causing error action). At the end of the 6 hours of counting, the microcontroller 43 will detect if it is daytime. If it is daytime, the microcontroller 43 controls the relay 45 to continuously disconnect electric current output to the bulb of the bulb socket 3 and record that it is daytime. If the light sensor 8 detects again the day is dark, the light sensor 8 will control the relay 45 to output electric current to the bulb socket 3 such that the bulb on the bulb socket 3 is turned on for 6 hours. In the way, the on and off of the bulb on the bulb socket 3 can be controlled.

FIG. 4 is a perspective assembly view of another preferred embodiment of the present invention. Referring to FIG. 4, another preferred embodiment of the present invention further comprises a power output line 9 disposed through the power line opening 23 for power line and coupled with the power input line 1. Also, on the upper end of the power output line 9 is provided with a socket 91 such that the plug 11 of the power input line 1 can be plugged in for electric current.

Figure 5:
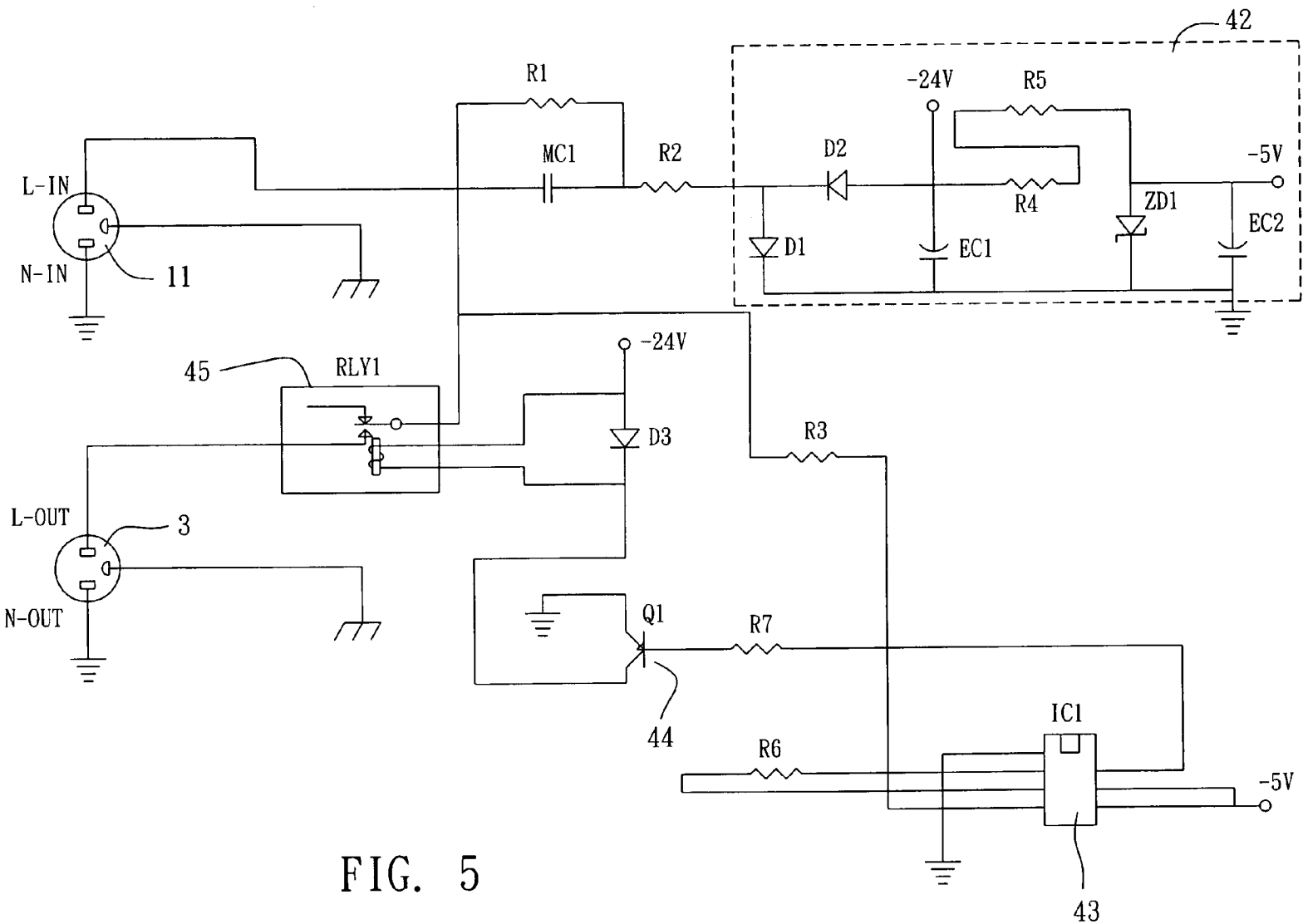
FIG. 5 is a schematic illustration of a preferred embodiment of a circuit according to the present invention.

FIG. 5 is a schematic illustration of a preferred embodiment of circuit the present invention. Referring to FIG. 5, in the lamp holder with a securing stake according to the present invention, when electric current is first transmitted to the bulb socket 3, the microcontroller 43 starts to count 6 hours of time and sends out a low-voltage control signal (in another embodiment, however, a control signal of NPN transistor and high-voltage can also be used) to the amplifying circuit 44 such that the PNP transistor 44 is turned on to actuate the relay 45. Consequently, the electric current can be output from the plug 11 to the bulb socket 3 to turn on the bulb (not shown) on the bulb socket 3. At the end of 6 hours, the microcontroller 43 sends out a high-voltage control signal to turn off the PNP transistor 44 and thus the relay 45 cuts off electric current output to the bulb socket 3 such that the bulb on the bulb socket 3 is turned off. Meanwhile, the timer in the microcontroller 43 starts to count 18 hours. At the end of the 18 hours, the microcontroller 43 sends out again a low-voltage control signal to the amplifying circuit 44 such that the PNP transistor 44 is turned on to actuate the relay 45 and starts again to count 6 hours. In the way, the on and off of the bulb on the bulb socket 3 can be controlled repeatedly.

Figure 6:
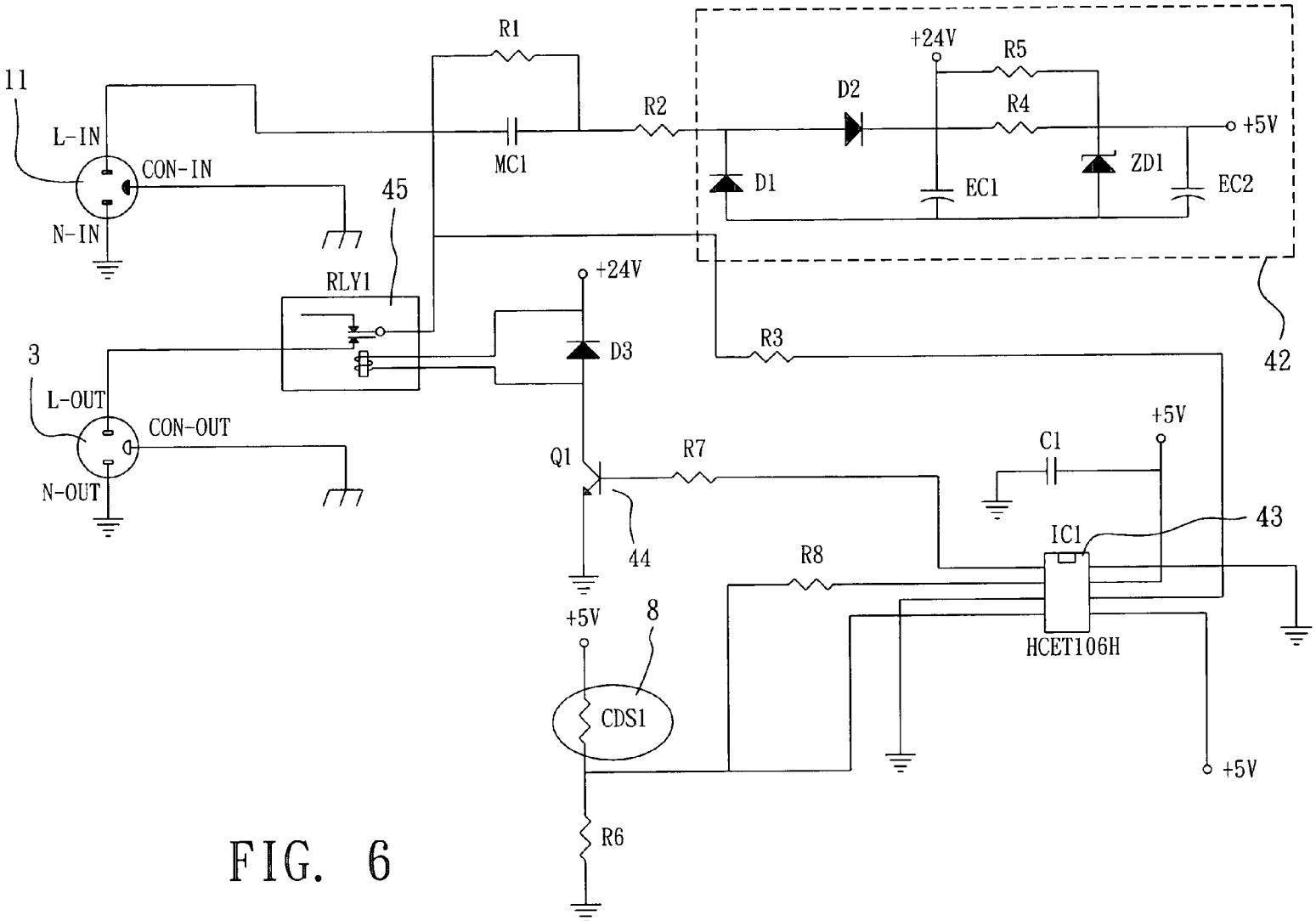
FIG. 6 is a schematic illustration of another preferred embodiment of the circuit of the light sensor 8 according to the present invention

FIG. 6 is a schematic illustration of another preferred embodiment of the circuit of the light sensor 8 according to the present invention. Referring to FIG. 6, when electric current is first transmitted to the bulb socket 3, if the light sensor 8 detects light signals, the microcontroller 43 will control the relay 45 to disconnect electric current output to the bulb socket 3 such that the bulb on the bulb socket 3 is turned off. If the light sensor 8 detects no light signals, the microcontroller 43 starts to count 6 hours and controls the relay 45 to output electric current to the bulb socket 3 such that the bulb on the bulb socket 3 is turned on. The microcontroller 43 will only control the relay 45 to disconnect electric current after the 6 hours of counting unless the light sensor 8 detects very strong light during the 6 hours period of counting. At the end of the 6 hours of counting, the microcontroller 43 will detect if it is daytime. If it is daytime, the microcontroller 43 controls the relay 45 to continuously disconnect electric current output to the bulb of the bulb socket 3 and record that it is daytime. If the light sensor 8 detects again the day is dark, the light sensor 8 will control the relay 45 to output electric current to the bulb socket 3 such that the bulb on the bulb socket 3 is turned on for 6 hours. In the way, the on and off of the bulb on the bulb socket 3 can be controlled.

Consequently, by putting the present invention into practice, the lamp holder can be secured in a garden or yard and equipped with a timer or light sensor to facilitate more efficient control of on and off of the lamp.

While the invention has been described with reference to the a preferred embodiment thereof, it is to be understood that modifications or variations may be easily made without departing from the spirit of this invention, which is defined by the appended claims.

What is claimed is:

1. A lamp holder with a securing stake, comprising:

a power input line provided with a plug;

a main body provided with an accommodating space whose front end is provided with an opening, whose back end is provided with an power line opening for the passing of a power line, and whose bottom is provided with a protrusion, which is provided with a connecting part;

a bulb socket disposed in the accommodating space;

a control circuit disposed in the accommodating space and coupled with the bulb socket and the power line, the control circuit having:

a printed circuit board disposed in the accommodating space;

a voltage-down and rectifying circuit disposed on the printed circuit board and coupled with the power input line;

a microcontroller disposed on the printed circuit board and coupled with the voltage-down and rectifying circuit;

an amplifying circuit disposed on the printed circuit board and coupled with the microcontroller; and a relay disposed on the printed circuit board, coupled with the amplifying circuit, and controlled by the microcontroller to connect or disconnect the electric current output to the bulb socket; and a securing stake whose upper end is provided with a protrusion which is provided with a connecting part, such that the connecting part of the main body and the connecting part of the securing stake is connected together to assemble the lamp holder with a securing stake.

2. The lamp holder with a securing stake as defined in claim 1, wherein a timer provided in the microcontroller starts to count 6 hours when electric current is first transmitted to the lamp holder and the microcontroller controls the relay to output electric current to the bulb socket such that the bulb on the bulb socket is turned on; at the end of the 6 hours of counting, the microcontroller controls the relay to disconnect electric current output to the bulb socket and thus to turn off the bulb; meanwhile, the timer in the microcontroller starts to count 18 hours and at the end of the 18 hours, the microcontroller starts again to count 6 hours and output electric current to the bulb socket such that the bulb on the bulb socket is turned on and the on and off of the bulb on the bulb socket is controlled.

3. The lamp holder with a securing stake as defined in claim 1, further comprising a light sensor and a transparent window provided on the top of the main body, wherein the light sensor is disposed in the accommodating space and coupled with the control circuit, and the light sensor is attached close to the transparent window such that the light sensor receives light signals from around the bulb socket.

4. The lamp holder with a securing stake as defined in claim 3, wherein a timer is provided in the microcontroller and when electric current is first transmitted to the lamp holder if the light sensor detects light signals, the microcontroller will control the relay to disconnect electric current output to the bulb socket such that the bulb on the bulb socket is turned off; if the light sensor detects no light signals, the microcontroller starts to count 6 hours and controls the relay to output electric current to the bulb socket such that the bulb on the bulb socket is turned on; the microcontroller will only control the relay to disconnect electric current after the 6 hours of counting unless the light sensor detects very strong light during the 6 hours period of counting; at the end of the 6 hours of counting, the microcontroller will detect if it is daytime; if it is daytime, the microcontroller controls the relay to continuously disconnect electric current output to the bulb on the bulb socket and record that it is daytime; if the light sensor detects again the day is dark, the light sensor will control the relay to output electric current to the bulb socket such that the bulb on the bulb socket is turned on for 6 hours; in the way, the on and off of the bulb on the bulb socket is controlled.

5. The lamp holder with a securing stake as defined in claim 3, wherein the light sensor is a photo resistor.

6. The lamp holder with a securing stake as defined in claim 1, wherein the amplifying circuit is a transistor.

7. The lamp holder with a securing stake as defined in claim 1, wherein the securing stake decreasing in size to a sharp end.

8. The lamp holder with a securing stake as defined in claim 1, wherein the main body and the securing stake are made of insulating material.

9. The lamp holder with a securing stake as defined in claim 1, wherein the opening is a flaring opening and the connecting part is a tightening hole.

10. The lamp holder with a securing stake as defined in claim 1, further comprising a power output line disposed in the power line opening and coupled with the power input line, and the top end of the power output line is provided with a socket for another plug to be plugged in for electric current.

11. The lamp holder with a securing stake as defined in claim 1, wherein said main body is made of plastic material.

12. The lamp holder with a securing stake as defined in claim 11, wherein said main body is made by molding method.

13. The lamp holder with a securing stake as defined in claim 1, wherein said main body is made of metal material.

* * * * *